US006240935B1

(12) United States Patent
Chang

(10) Patent No.: US 6,240,935 B1
(45) Date of Patent: Jun. 5, 2001

(54) BOELUBE R DISSOLVING ALKALINE CLEANING SOLUTION

(75) Inventor: Cathleen H. Chang, Renton, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/539,009

(22) Filed: Mar. 30, 2000

(51) Int. Cl.[7] ..... B08B 3/04

(52) U.S. Cl. ..... 134/2; 134/2; 134/19; 134/22.17; 134/22.19; 134/32; 134/34; 134/36; 134/40; 134/42; 510/247; 510/252; 510/421; 510/495

(58) Field of Search ..... 134/2, 19, 22.17, 134/22.19, 32, 34, 36, 40, 42; 510/247, 252, 421, 495

(56) References Cited

U.S. PATENT DOCUMENTS

| | | | | |
|---|---|---|---|---|
| 4,000,082 | * | 12/1976 | Otrhalek et al. | 252/135 |
| 4,108,246 | | 8/1978 | Jones . | |
| 4,155,857 | | 5/1979 | Jones . | |
| 4,199,624 | * | 4/1980 | Smith | 427/309 |
| 4,279,768 | | 7/1981 | Busch . | |
| 4,810,405 | | 3/1989 | Waller et al. . | |
| 5,023,011 | | 6/1991 | Busch et al. . | |
| 5,024,783 | | 6/1991 | Busch et al. . | |
| 5,482,641 | * | 1/1996 | Fleisher | 252/90 |
| 5,545,347 | | 8/1996 | Ouyang et al. . | |
| 5,634,979 | | 6/1997 | Carlson et al. . | |
| 5,700,768 | * | 12/1997 | Lu | 510/214 |
| 5,786,313 | * | 7/1998 | Schneider et al. | 510/219 |

OTHER PUBLICATIONS

The Orelube Corporation, web page at www.orelube.com/page3.htm, Boelube® "A Better Way" (one page).

The Orelube Corporation, web page at www.orelube.com/page4.html, Boelube® "Data," Subject: Boelube® 70104 (100A)/70106 (100F) The Premier Lubricant For Mist Applications. (two pages).

The Orelube Corporation, web page at www.orelube.com/page7.html, Boelube® Product List, "Boelube® Liquid For Mist Applications 70104 (Red) 100A 70106 (Clear) B90 (Clear)" (one page).

The Orelube Corporation, Material Safety Data Sheet, Product Name: Boelube 70106, Synonym: 100F, Date Prepared: Aug. 6, 1997, The Orelube Corporation, Plainview, New York (two pages).

N. Irving Sax and Richard J. Lewis, Sr. Hawley's Condensed Chemical Dictionary, Eleventh Edition (1987), pp. 1033, 1034 (defenition of "sequestration"), and 1061 (definition of "sodium gluconate"), Van Nostrand Reinhold, New York (four pages).

Spectrum Chemical MFG. Corp., Gardena, California, Material Safety Data Sheet, Product Name: Sodium Gluconate, S0168, four pages, web address: http://www.hazard-.com/msds/h/q177/q398.html.

Stepan Company, Northfield, Illinois, Material Safety Data Sheet, Product Name: 121150 Sodium Xylene Sulfonate, two pages, web address: http://www.hazard.com/msds/h/q402/q334.html.

Shell Oil Co., Houston, Texas, Material Safety Data Sheet, Product Name: 38194, Neodol 91–6, four pages, web address: http://www.hazard.com/msds/h/q469/q376.html.

McGean–Rohco, Inc., Livonia, Michigan, Material Safety Data Sheet, Product Name: Roprepp Deruster WT, four pages.

* cited by examiner

*Primary Examiner*—Sharidan Carrillo
(74) *Attorney, Agent, or Firm*—Paul C. Cullom

(57) ABSTRACT

A process for descaling, derusting, dissolving, and removing machining lubricants coated on steel and other iron alloy objects, the process comprising the steps of: (a) providing an alkaline cleaning solution consisting of: water; about 2.5% to 25% by weight of a water-soluble alkali; about 2% to 8% by weight of sodium gluconate; about 5% to 20% by weight of sodium xylene sulfonate; and about 2% to 20% by weight of a water-soluble surfactant consisting of C9–C11 alcohol ethoxylates and 6 ppm of ethylene oxides; and (b) contacting the soiled object with the alkaline cleaning solution at a temperature of about 60° F. to 200° F. for about 3 to 30 minutes, wherein the object is descaled, derusted, and the machining lubricant is dissolved and removed.

3 Claims, No Drawings

BOELUBE R DISSOLVING ALKALINE CLEANING SOLUTION

BACKGROUND OF THE INVENTION

This invention is in the field of water-base alkaline cleaning solutions that are used to descaled and derusted objects made of steel and other iron alloys. The soiled object that needs to be descaled and derusted, for example a drill bit, may be contaminated with a water-insoluble machining lubricant and a smut consisting generally of machining lubricant and small metal particles congealed together. Conventional water-base alkaline cleaning solutions do not have the ability to completely dissolve machining lubricants. The present invention has this ability.

An example of a widely-used water-insoluble machining lubricant is a machining lubricant manufactured by The Orelube Corporation, of Plainview, N.Y. 11803, and sold under the trademark BOELUBE® 70106. This product, BOELUBE® 70106, is a long chain alcohol-base machining lubricant, which is a free flowing, water-insoluble liquid at room temperature. Further information about the composition of BOELUBE® 70106 may be found in its Material Safety Data Sheet of Aug. 6, 1997 which is incorporated by reference herein.

BRIEF SUMMARY OF THE INVENTION

In one aspect the invention is an improved alkaline cleaning solution that has the ability to descale, derusted, and completely dissolve machining lubricants (such as BOELUBE® 70106) coated on steel and other iron alloy objects, the alkaline cleaning solution consisting essentially of: (a) water; (b) about 2.5% to 25% by weight of a water-soluble strong alkali; (c) about 2% to 8% by weight of a water-soluble sequestering agent selected from the group consisting of sodium gluconate and its functional equivalents; (d) about 5% to 20% by weight of a water-soluble complexing agent selected from the group consisting of sodium xylene sulfonate and its functional equivalents; and (e) about 2% to 20% by weight of a water-soluble surfactant selected from the group consisting of NEODOL 91-6 and its functional equivalents.

In another aspect the invention is a process for descaling, derusting, and completely dissolving and removing machining lubricants coated on steel and other iron alloy objects, the process comprising the steps of: (a) providing an alkaline cleaning solution consisting essentially of: water; about 2.5% to 25% by weight of a water-soluble strong alkali; about 2% to 8% by weight of a water-soluble sequestering agent selected from the group consisting of sodium gluconate and its functional equivalents; about 5% to 20% by weight of a water-soluble complexing agent selected from the group consisting of sodium xylene sulfonate and its functional equivalents; and about 2% to 20% by weight of a water-soluble surfactant consisting of NEODOL 91-6 and its functional equivalents; and (b) contacting the soiled object with the alkaline cleaning solution at a temperature of about 60° F. to 200° F. for about 3 to 30 minutes, whereby the object is descaled, derusted, and the machining lubricant is completely dissolved and removed.

DETAILED DESCRIPTION OF THE INVENTION

The BOELUBE® dissolving alkaline cleaning solution of the present invention is a water-based mixture consisting of a water-soluble surfactant, a water-soluble complexing agent, a water-soluble sequestering agent, a strong alkali, and water. The present invention will completely dissolve and remove a water-insoluble machining lubricant, such as BOELUBE® 70106 (hereafter referred to as "BOELUBE®"), from objects made of steel and other iron alloys, for example, steel drill bits that have been used in drilling and that have become contaminated with machining lubricant and a smut generally consisting of machining lubricant and small metal particles congealed together. Complete solubilization of the machining lubricant is achieved by using the improved water-base alkaline cleaning solution consisting of a water-soluble surfactant, a water-soluble complexing agent, a water-soluble sequestering agent, a strong alkali, and water. It is designed to descale steel and other iron alloys. The present BOELUBE® dissolving alkaline cleaning solution can also be used on other tools (such as reamers, saws, broachers, grinders, taps, millers, thread cutters, deburrers, punches) that have become coated with machining lubricant and smut.

The preferred water-soluble surfactant is the surfactant sold under the trademark NEODOL 91-6 by Shell Oil Co., P. O. Box 4320, Houston, Tex. 77210, or its functional equivalent. This slightly viscous liquid product contains C9–C11 alcohol ethoxylates and 6 ppm of ethylene oxides. The concentration of NEODOL 91-6 added to the cleaning solution may vary between about 2% to 20% by weight. The preferred concentration of NEODOL 91-6 is 5% by weight.

The preferred water-soluble complexing agent added to the cleaning solution is sodium xylene sulfonate or its functional equivalent. The concentration of the complexing agent may vary between about 5% to 20% by weight. The preferred concentration of the complexing agent is 12% by weight.

The ratio between surfactant and complexing agent is important in the proper functioning of the present cleaning solution. The preferred ratio of surfactant to complexing agent is 5:12 by weight.

The preferred water-soluble sequestering agent is sodium gluconate or its functional equivalent. The concentration of the sequestering agent may vary between about 2% to 8% by weight. The preferred concentration of the sequestering agent is 5% by weight.

The preferred strong alkali is sodium hydroxide. The concentration of the strong alkali may vary between about 2.5% to 25% by weight. The preferred concentration of the strong alkali is 7.5% by weight.

The metal build-up and dust from mechanical operations results in metal ions in the alkaline cleaning solution. The metal ions (such as aluminum ions) must be tied up to prevent them from interfering with the cleaning and to prevent redeposition on the object to be cleaned. The sequestering agent (such as sodium gluconate) keeps the metal ions soluble and away from the object to be cleaned.

There are numerous other commercially available alkaline cleaning agents intended to remove common oil and smut on metals. However, they were unsuccessful in completely removing the machining lubricant BOELUBE® and the smut generally consisting of the machining lubricant and small metal particles congealed together. The improved alkaline cleaning solution of this invention will completely dissolve and remove the machining lubricant BOELUBE® and the smut.

The soiled object to be cleaned should be in contact with the alkaline cleaning solution at a temperature of about 60° F. to 200° F. for about 3 to 30 minutes, whereby the object is descaled, derusted, and the machining lubricant is completely dissolved and removed.

EXAMPLE

Testing has been carried out to demonstrate that the present alkaline cleaning solution is effective at completely dissolving the widely-used machining lubricant BOELUBE® and the smut generally consisting of the machining lubricant and small metal particles congealed together on steel drill bits. The testing was performed in a small alkaline cleaning tank.

The improved alkaline cleaning solution was prepared and operated as follows:

1. Tanks: Tanks and associated equipment must be fabricated from stainless steel.

2. Charging the Alkaline Cleaning Tank (for example, a small 1-liter tank was used for testing): To have a 7.5% by weight concentration of sodium hydroxide, charge the tank with 850 ml of cool clean water, start the mechanical agitation, and then slowly add 150 ml of sodium hydroxide solution (at a 50% by weight concentration of sodium hydroxide in water) to the agitating tank.

3. Then add 50 g of sodium gluconate (technical grade) to the solution to achieve 5% by weight concentration of sodium gluconate.

4. Then add 120 g of sodium xylene sulfonate to achieve 12% by weight concentration of sodium xylene sulfonate.

5. Finally, add 50 ml of NEODOL 91-6 to achieve 5% by weight concentration of NEODOL 91-6. This results in the preferred BOELUBE® dissolving alkaline cleaning solution.

6. Processing In the Alkaline Cleaning Tank: Maintain tank at 130° F. Immerse the contaminated drill bits completely for 24 minutes with mechanical agitation of the basket containing the drill bits for maximum contact with the improved alkaline cleaning solution.

7. Processing At the Dirty Rinse Water Tank (another small 1-liter tank): The dirty rinse water is at room temperature. Immerse the drill bits completely for 6 minutes with mechanical agitation of the basket containing the drill bits for maximum contact with the rinse water.

8. Charging The Clean Rinse Water Tank (another small 1 liter tank): To have 1.0% by volume of TURCO® RUST BLOC (the trademark for a rust inhibitor sold by Turco Products, Inc. of Westminster, Calif. 92654), charge tank with 990 ml of cool clean water. Start the mechanical agitation and then slowly add 10 ml of TURCO RUST BLOC to the agitating water.

9. Processing At the Clean Rinse Water Tank: Maintain tank at 170° F. Immerse drills completely for 6 minutes with mechanical agitation of the basket containing the drill bits for maximum contact with the rinse water. The drill bits are now removed and dried by conventional methods.

My testing indicated that the present cleaning solution is able to dissolve up to 1.2 volume % of BOELUBE® 70106. When the volume of BOELUBE® 70106 exceeds 1.2% in volume, it is necessary to increase the concentrations of the surfactant and the complexing agent (while maintaining the preferred ratio of surfactant to complexing agent of 5:12 by weight).

As will be apparent to those skilled in the art to which the invention is addressed, the present invention may be embodied in forms other than those specifically disclosed above, without departing from the spirit or essential characteristics of the invention. The particular embodiments of the invention described above and the particular details of the processes described are therefore to be considered in all respects as illustrative and not restrictive. The scope of the present invention is as set forth in the appended claims rather than being limited to the examples set forth in the foregoing description. Any and all equivalents are intended to be embraced by the claims.

What is claimed is:

1. A process for descaling, derusting, dissolving, and removing machining lubricants coated on steel and other iron alloy objects, said process comprising the steps of:

(a) providing an alkaline cleaning solution consisting of: water; about 2.5% to 25% by weight of a water-soluble alkali; about 2% to 8% by weight of sodium gluconate; about 5% to 20% by weight of sodium xylene sulfonate; and about 2% to 20% by weight of a water-soluble surfactant consisting of C9–C11 alcohol ethoxylates and 6 ppm of ethylene oxides; and (b) contacting said soiled object with said alkaline cleaning solution at a temperature of about 60° F. to 200° F. for about 3 to 30 minutes, wherein said object is descaled, derusted, and said machining lubricant is dissolved and removed.

2. The process of claim 1 wherein said water-soluble alkali is sodium hydroxide.

3. A process for descaling, derusting, dissolving, and removing machining lubricant coated on a drill bit, said process comprising the steps of:

(a) providing an alkaline cleaning solution consisting of: water; about 2.5% to 25% by weight of a water-soluble alkali; about 2% to 8% by weight of sodium gluconate; about 5% to 20% by weight of sodium xylene sulfonate; and about 2% to 20% by weight of a water-soluble surfactant consisting of C9–C11 alcohol ethoxylates and 6 ppm of ethylene oxides;

(b) contacting said soiled drill bit with said alkaline cleaning solution at a temperature of about 60° F. to 200° F. for about 3 to 30 minutes, wherein said drill bit is descaled, derusted, and said machining lubricant is dissolved and removed; and (c) rinsing said drill bit in clean water.

* * * * *